US005342110A

United States Patent [19]

Merrick

[11] Patent Number: 5,342,110

[45] Date of Patent: Aug. 30, 1994

[54] STADIUM CHAIR SEATING SYSTEM

[75] Inventor: Bruce C. Merrick, Goshen, Ky.

[73] Assignee: Dant Corporation, Louisville, Ky.

[21] Appl. No.: 908,976

[22] Filed: Jul. 6, 1992

[51] Int. Cl.[5] ..... A47C 15/00

[52] U.S. Cl. ..... 297/232; 297/452.14; 297/452.65; 52/9

[58] Field of Search ..... 297/232, 452, 248, DIG. 2, 297/192, 454, 457; 52/8, 9

[56] References Cited

U.S. PATENT DOCUMENTS 3,574,400 4/1971 Day ..... 297/457
3,669,496 6/1972 Chisolm ..... 297/457 X
3,717,378 2/1973 Jackson ..... 297/457 X
4,968,091 11/1990 Mariol ..... 297/457 X

FOREIGN PATENT DOCUMENTS 1812254 8/1970 Fed. Rep. of Germany ..... 297/232

*Primary Examiner*—Laurie K. Cranmer
*Attorney, Agent, or Firm*—Woodward, Emhardt, Naughton, Moriarty & McNett

[57] ABSTRACT

A one-piece rotationally molded plastic stadium seating chair module for assembly in side-by-side relationship in rows with each said chair module attached to a common supporting understructure. The chair module has a hollow, double wall construction and integrally formed seat, back, and armrest portions.

12 Claims, 16 Drawing Sheets

STADIUM CHAIR SEATING SYSTEM

BACKGROUND OF THE INVENTION

This invention relates generally to stadium seating, and in particular to a stadium seating system which is provided with a plurality of chair modules having a one piece molded plastic construction.

Primarily because of their lesser cost, many stadiums employ bleacher type seating. Nevertheless, because of the additional comfort afforded by individual chair type seating such seating is becoming increasingly popular. Part of the added cost in installing chair type seating involves the cost of the chair itself. In order to minimize the amount of space which is needed between rows, retractable chairs having flip-up type seats or other arrangements are used. These type chairs are typically more expensive by virtue of their construction than chairs having only a fixed seat. While flip-up or retractable style chairs are cost effective for indoor stadiums where the additional roof expense needed to cover the larger seating area outweighs the additional expense needed to make the chairs retractable, such considerations do not apply in outdoor stadium seating situations.

Whether or not the chairs are retractable, present stadium chair designs are characterized by a multi-piece construction in which the seat, back, and armrests are separately formed and interconnected by various type fasteners and/or interlocking framework. To minimize expense and yet provide sufficient durability and comfort, the seat and backs are typically formed of a durable plastic, such as high density polyethylene, which resists cracking, warping and peeling whereas the interconnecting framework may be made of a suitable metal material, such as aluminum. Typically also, the plastic formed seat and back portions are stationary injection molded and have a single wall construction with reinforcing ribs for added strength. This multi-piece, multi-material construction for a stadium seating chair is employed despite its added expense over a one-piece integral plastic chair because a one-piece chair construction formed by conventional stationary injection molding techniques would lack sufficient strength for practicable use in stadium seating applications.

Another disadvantage contributing to the premium cost of individual chair-type stadium seating involves the way in which the chairs are installed relative to the understructure. Conventional stadium seating chairs are configured so as to require building a closed deck type stadium seating understructure upon which the chairs are then installed. In a closed deck configuration there is no open space between floorboards and risers, in contrast with open or semi-open deck configurations usually associated with cheaper bleacher-type stadium seating, and thus no opportunity for articles or debris to fall through the seating area. The material and labor costs involved with installing a closed deck understructure is a significant part of the overall cost of the seating system and contributes to the high costs heretofore associated with such systems.

SUMMARY OF THE INVENTION

According to one preferred embodiment of the present invention there is provided a tiered stadium seating structure characterized by an understructure having a plurality of tiered risers and horizontally extending runners comprising an open framework. There is further provided a plurality of floorboards supported upon and extending transverely across the horizontally extending runners, wherein the floorboards only partially enclose the space defined by the open framework. Additionally, the structure is characterized by a plurality of identically formed chair modules having a one pieced molded plastic construction. Each of the chair modules includes a back, a seat rigidly connected and formed with the back, an arm rest, and a seat support means extending downwardly from the seat. Each of the chair modules is mounted directly to adjacent ones of the floor boards extending forwardly of and behind the chair modules, whereby the chair modules totally enclose the remaining open space between the risers and runners.

In a further preferred embodiment, the present invention is characterized by a one-piece rotationally molded plastic stadium seating chair module for assembly in side-by-side relationship in rows with each chair module attached to a common supporting understructure. The chair module may be further characterized as having a hollow, double wall construction and integrally formed seat, back, and armrest portions.

It is a principal object of this invention to provide a stadium seating structure incorporating individual chair type seating which is much less expensive than traditional chair type stadium seating arrangements and is competitive with the cost of bleacher type seating.

A further object of the present invention is to provide an individual chair type stadium seating structure in which the chairs have a modular one piece construction.

An additional object of the present invention is to provide chair type stadium seating which is designed so as to be built into and integrated with the design of the understructure thereby resulting in a material savings in the cost of floorboards and riserboards otherwise required beneath and behind the chairs and a savings in installation costs associated therewith.

A yet further object is to provide a stadium seating chair having a simple unitary design which provides ease of installation and maintenance, and which in one embodiment provides an underseat individualized storage compartment.

Related objects and advantages of the present invention will become more apparent by reference to the following figures and detailed description.

DESCRIPTION OF THE PREFERRED EMBODIMENT

Figure 1:
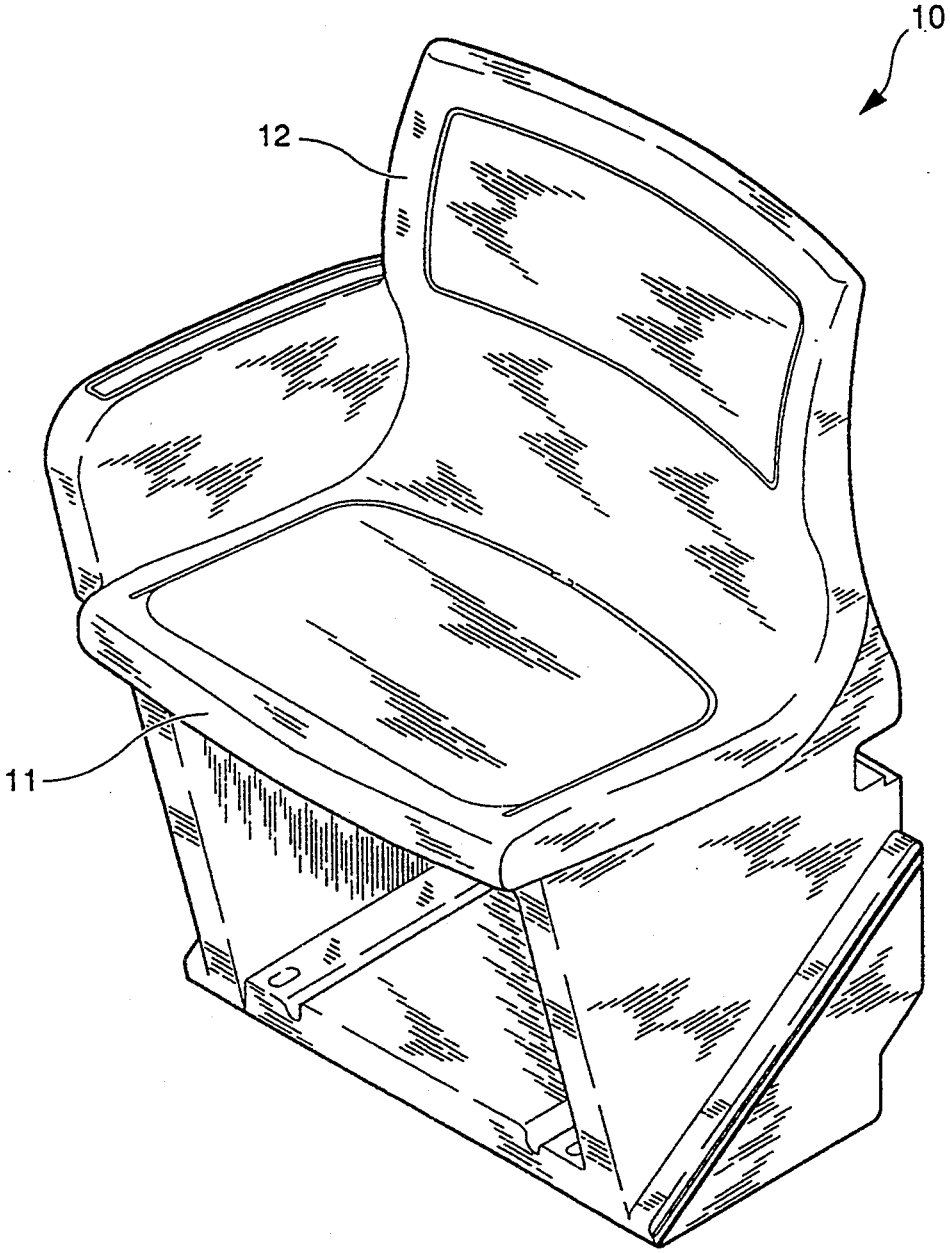
FIG. 1 is a perspective view of a preferred embodiment of the stadium chair module of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to the drawings in detail, FIGS. 1–14 show a preferred embodiment of the stadium chair module 10 used in forming the stadium seating system of the present invention. In contrast to conventional stadium chairs, stadium chair module 10 has a one-piece molded plastic construction and integrally includes a seat portion 11, back portion 12, armrest 13, and seat support portion 14.

Figure 6:
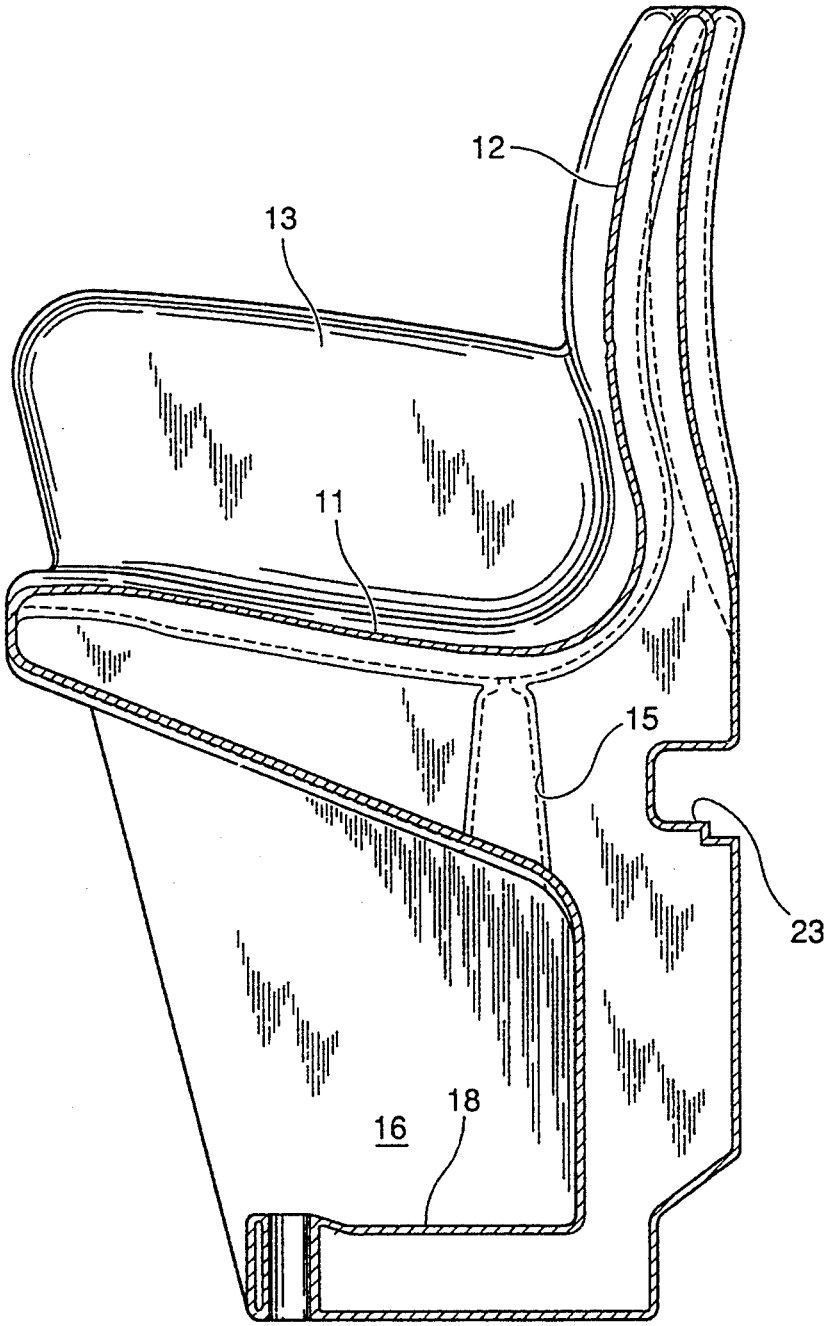
FIG. 6 is a section view taken along lines 6—6 in FIG. 3.
Figure 7:
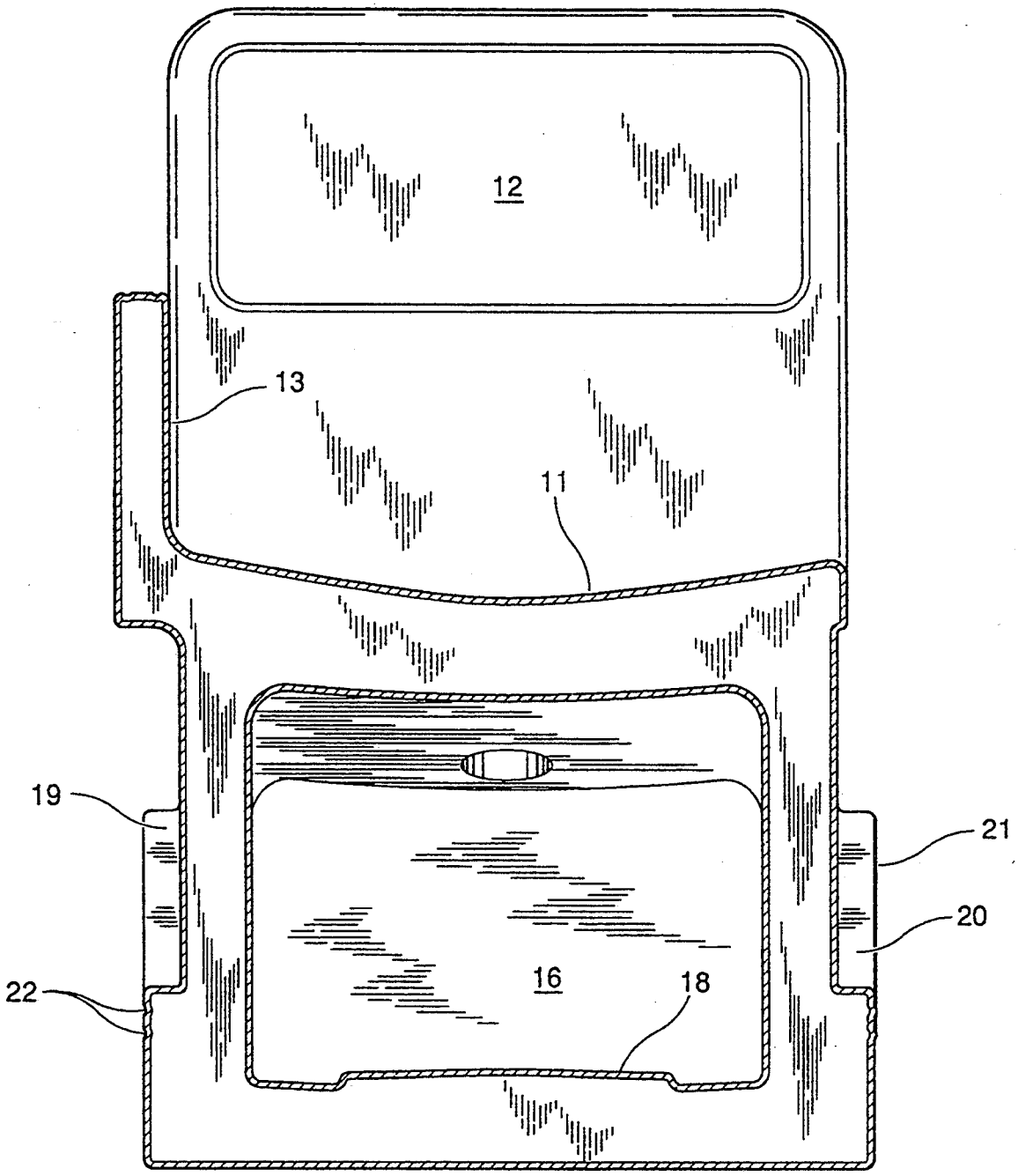
FIG. 7 is a section view taken along lines 7—7 in FIG. 2.

In order to provide strength and durability necessary for stadium seating applications and yet minimize cost, chair module 10 is formed by a rotational molding technique which provides a double wall construction shown in FIGS. 6 and 7. Rotational molding techniques have been used for many years to produce various types of plastic products but their advantages have not heretofore been appreciated and applied in the stadium seating industry. A rotational molding system is for example disclosed in U.S. Pat. No. 4,285,903 to Lemelson, which is hereby incorporated by reference herein.

In a preferred form, the chair module 10 is made from a high density polyethylene plastic polymer. Other polymer plastics having sufficient strength, durability and moldability characteristics may however also be suitably employed.

The seat portion 11, back portion 12 and armrest 13 have suitably contoured shapes which are intended to provide maximum support and comfort to the seat occupant within typical chair height, width and forward-/aft dimensional restrictions presented in stadium seating applications. The seat portion 11 is further contoured so that water will not tend to collect or pool thereon but rather will flow towards a drain 15, seen in FIG. 5, located at a medial/aft position on seat portion 11.

The seat support portion 14 integrally extends below seat portion 11 and forms a storage compartment space 16 which is totally enclosed except for a forward facing access opening located beneath the front of seat portion 11. Drain 15 communicates into the storage compartment through an opening located in the top wall thereof. A pair of channels or grooves 17 are provided in the bottom wall 18 defining the storage compartment space 16 and serve to channel water forwardly out of the storage compartment.

Figure 2:
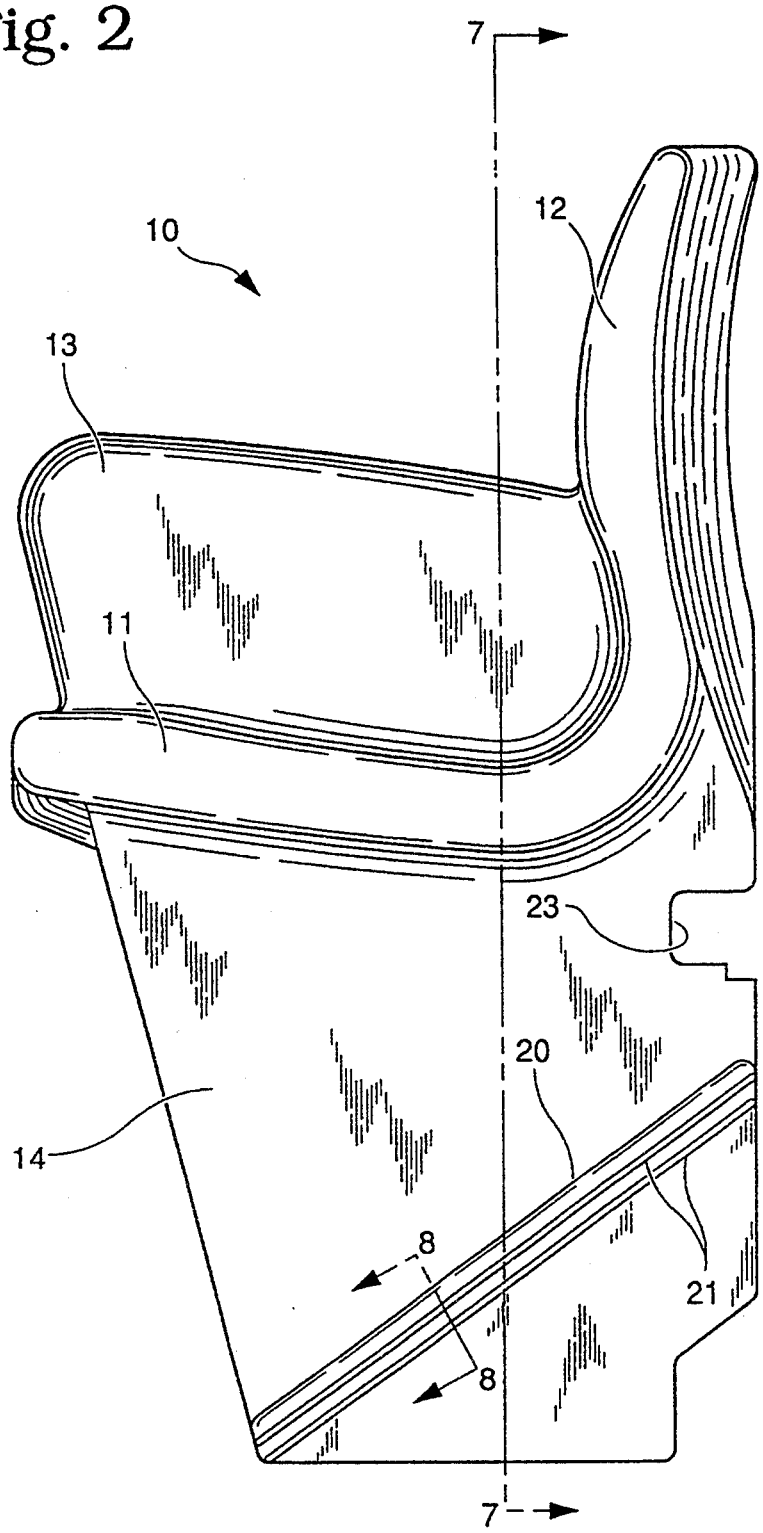
FIG. 2 is a right side elevation view of the stadium chair module of FIG. 1.
Figure 3:
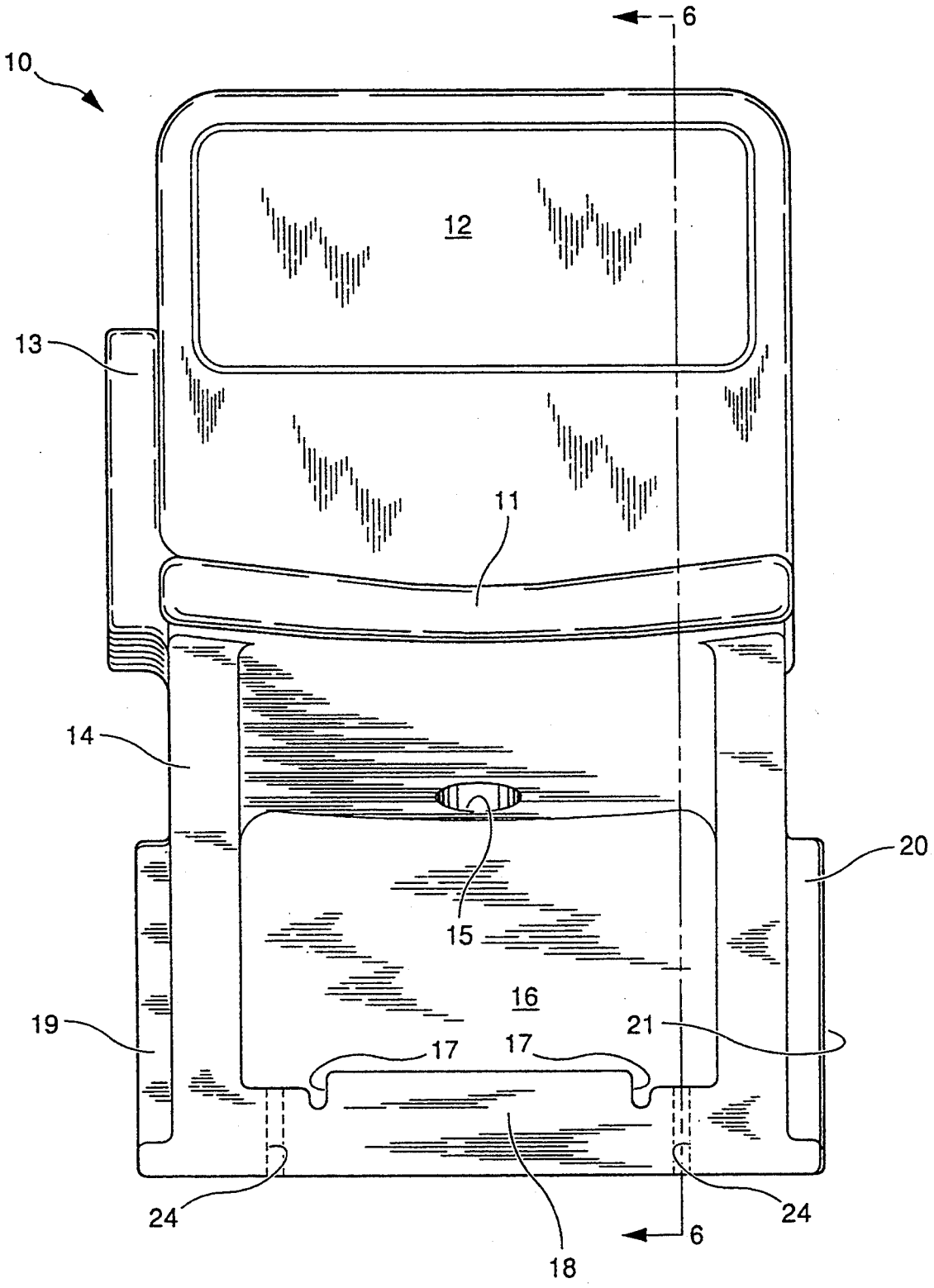
FIG. 3 is a front elevation view of the stadium chair module of FIG. 1.
Figure 4:
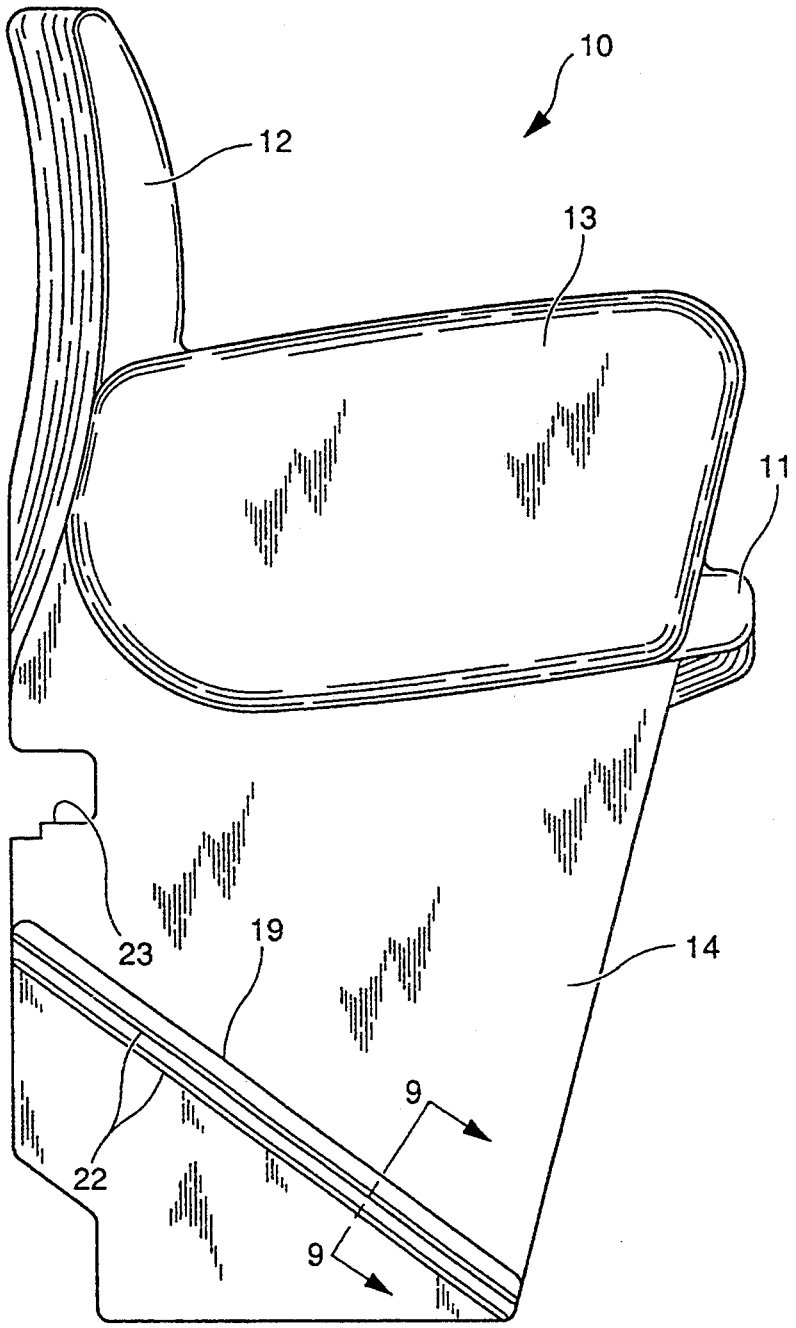
FIG. 4 is a left side elevation view of the stadium chair module of FIG. 1.
Figure 5:
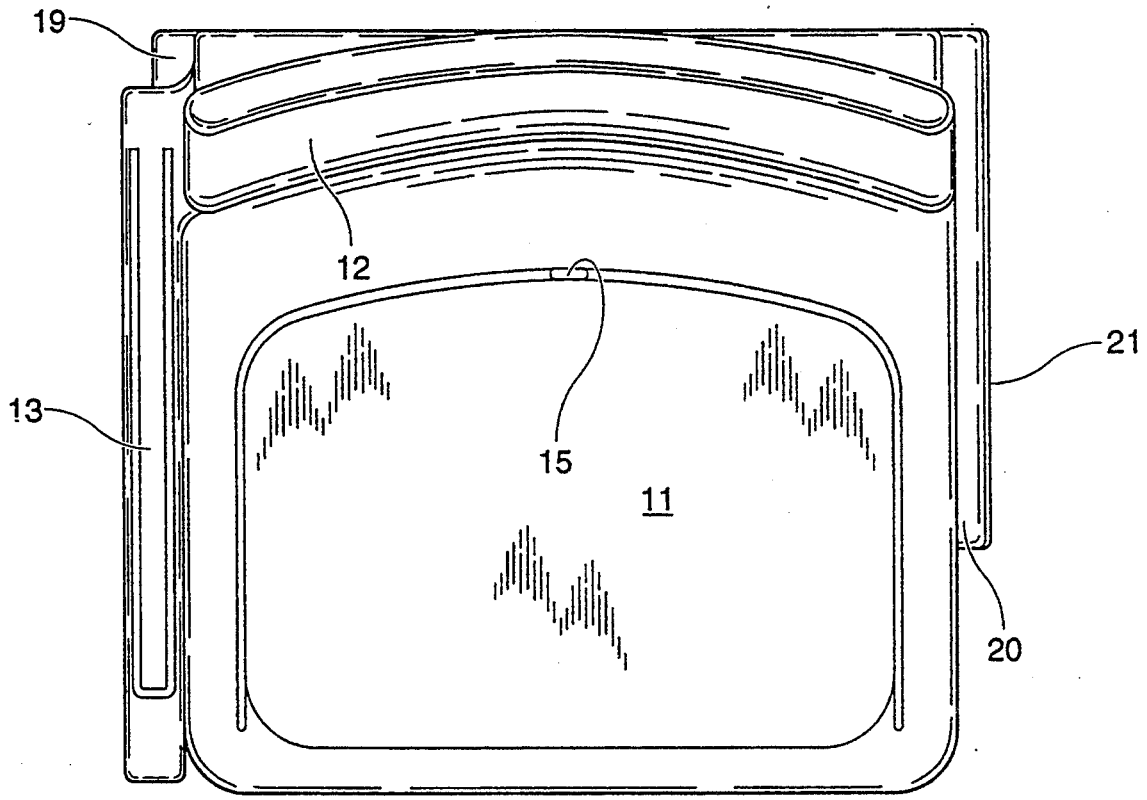
FIG. 5 is a top elevation view of the stadium chair module of FIG. 1.
Figure 8:
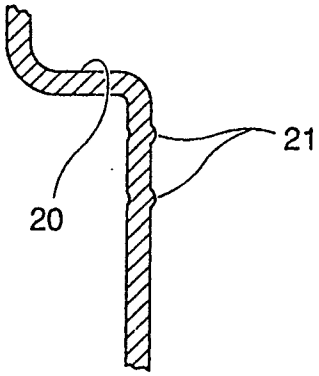
FIG. 8 is an enlarged fragmentary section view taken along lines 8—8 in FIG. 2.
Figure 9:
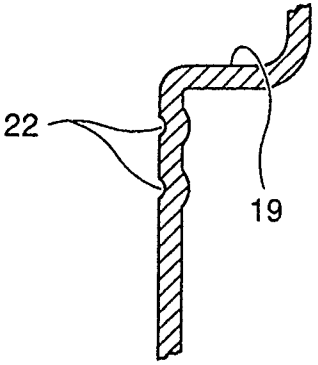
FIG. 9 is an enlarged fragmentary section view taken along lines 9—9 in FIG. 4.

A means is also provided on each side of the chair module 10 to permit the channeling of water downwardly through tiered rows of chair modules and away from seat occupants. Referring particularly to FIGS. 2, 4, 8 and 9, channels 19 and 20 integrally extend from the left and right sides, respectively, of seat support portion 14 in a downward sloping direction from the rear towards the front. As seen in FIGS. 2 and 8 a pair of spaced apart beads 21 extend from seat portion 14 parallel to and below the right side channel 20. Similarly, as seen in FIGS. 4 and 9 a pair of spaced apart grooves 22 extend from seat portion 14 parallel to and below the left side channel 19. Beads 21 are adapted to be matingly received in a tight fit within the grooves 22 on an adjacent identically formed chair module 10 and thereby prevent water flowing along channels 19 and 20 from escaping therebetween.

Figure 12:
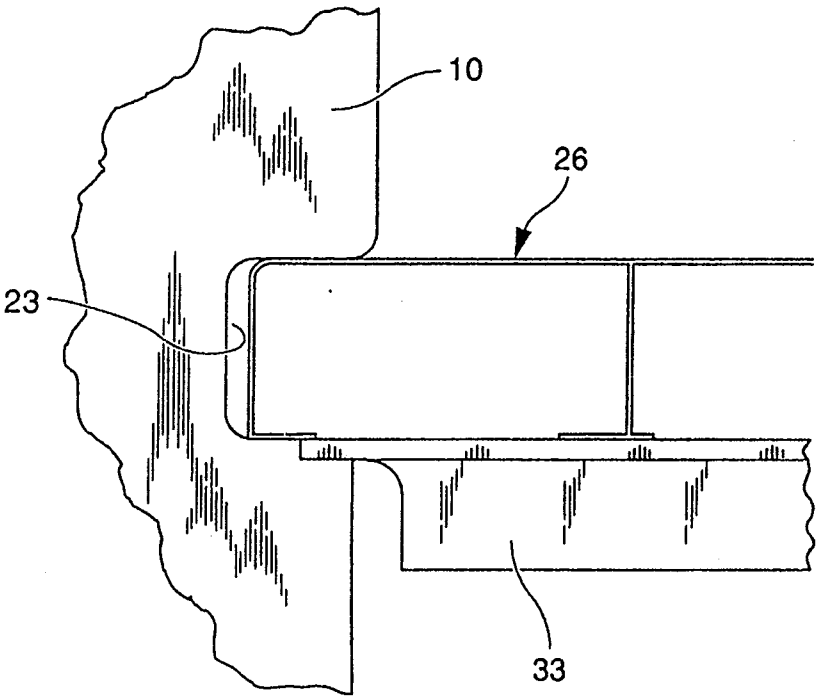
FIG. 12 is an enlarged fragmentary section view showing the manner in which the rear portion of the stadium chair module of FIG. 1 is attached to the stadium seating understructure.
Figure 11:
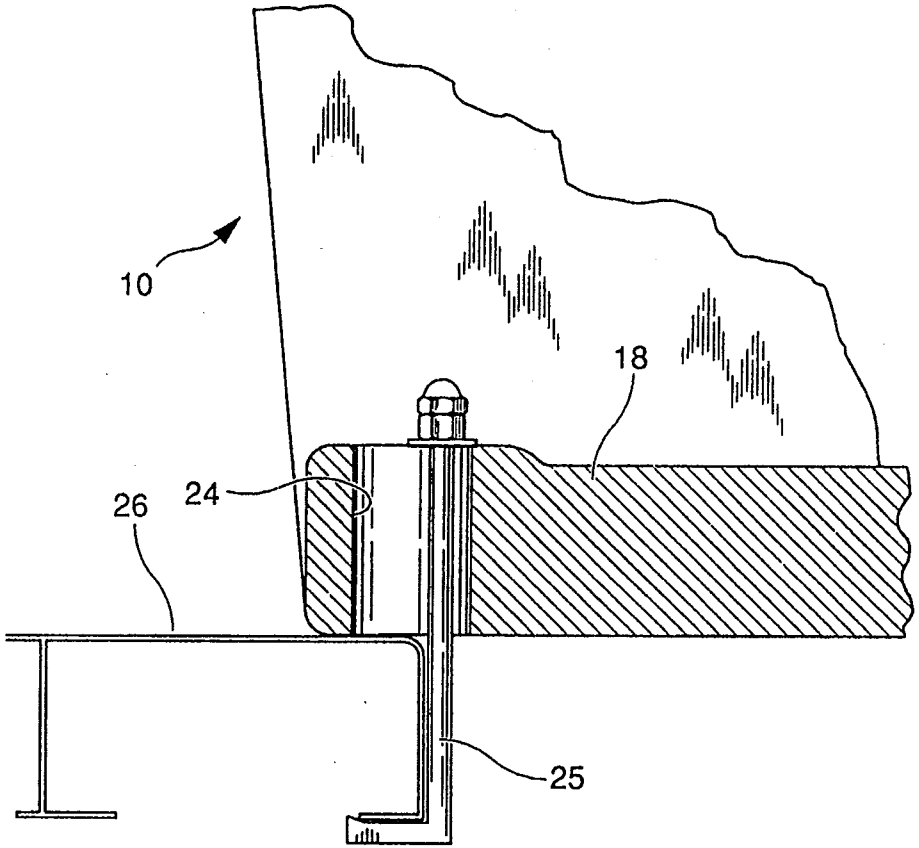
FIG. 11 is an enlarged fragmentary section view showing the manner in which the front portion of the stadium chair module of FIG. 1 is attached to the stadium seating understructure.

A recess 23 extends across the rear of chair module 10 above channels 19 and 20. As seen in FIG. 12 the recess 23 is adapted to receive the overhanging portion of a floorboard located behind chair module 10 in order to rigidly mount the rear portion of the chair module to the understructure as will be more fully described later herein. Chair module 10 also includes a pair of spaced apart mounting holes 24 extending through the bottom wall 18 of seat support portion 14. As seen in FIG. 11, mounting holes 24 serve to receive J-bolt type fasteners 25 in mounting the front bottom portion of the chair module 10 to a floorboard 26.

Figure 10:
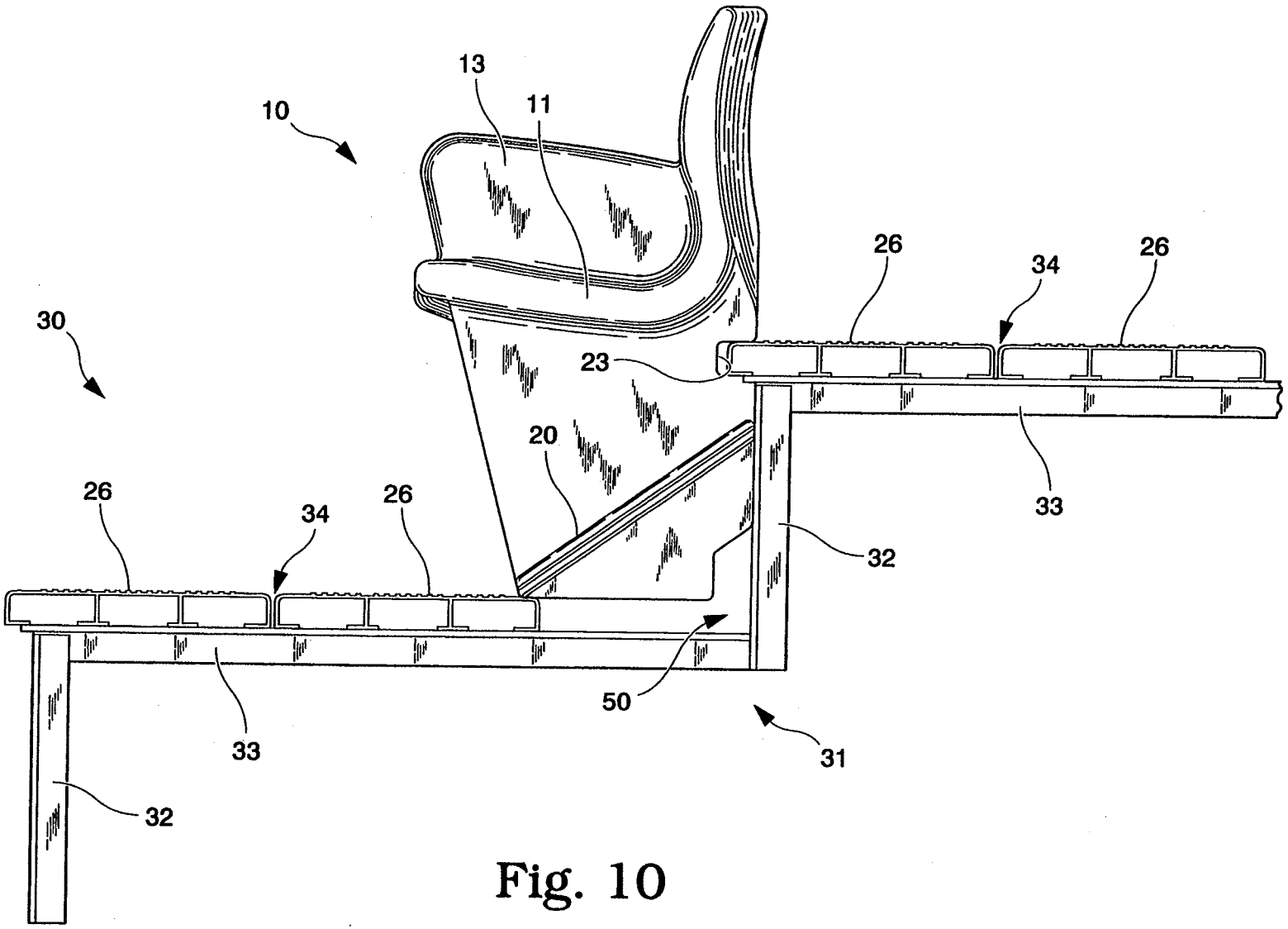
FIG. 10 is a fragmentary side elevation view showing the installation of the stadium chair module of FIG. 1 in a tiered stadium seating understructure.

A preferred stadium seating structure incorporating a plurality of identically formed chair modules 10 is shown in FIGS. 10–13 and generally designated at 30. Stadium seating structure 30 includes a conventional open framework type understructure 31 comprising a plurality of tiered metal riser and runner channel members 32 and 33, respectively, mounted to associated supporting members (not shown). A plurality of floorboards 26 are fixedly mounted upon and extend transversely to the runner channel members 33. Preferably, floorboards 26 are made of aluminum and extruded to shape. As seen in FIG. 10, each runner channel member 33 supports two floorboards 26 which are welded together along seam 34 to seal the space therebetween. Referring also to FIG. 12, the forwardmost floorboard 26 is positioned on runner channel member 33 so as to overhang a distance which is sufficient to allow it to be fully received in the mounting recess 23 of chair module 10 with chair module 10 positioned flush against riser channel member 32. Referring additionally to FIG. 11, the rearmost floorboard 26 extends beneath the bottom surface 35 of chair module 10 a distance which provides sufficient support area for the chair module, thus ensuring that chair module 10 will be securely held in position by J-bolt fasteners 25. It is to be appreciated that the rear of each chair module 10 is retained in position by the close fit between floorboard 26 and runner channel member 33 within recess 23.

Figure 13:
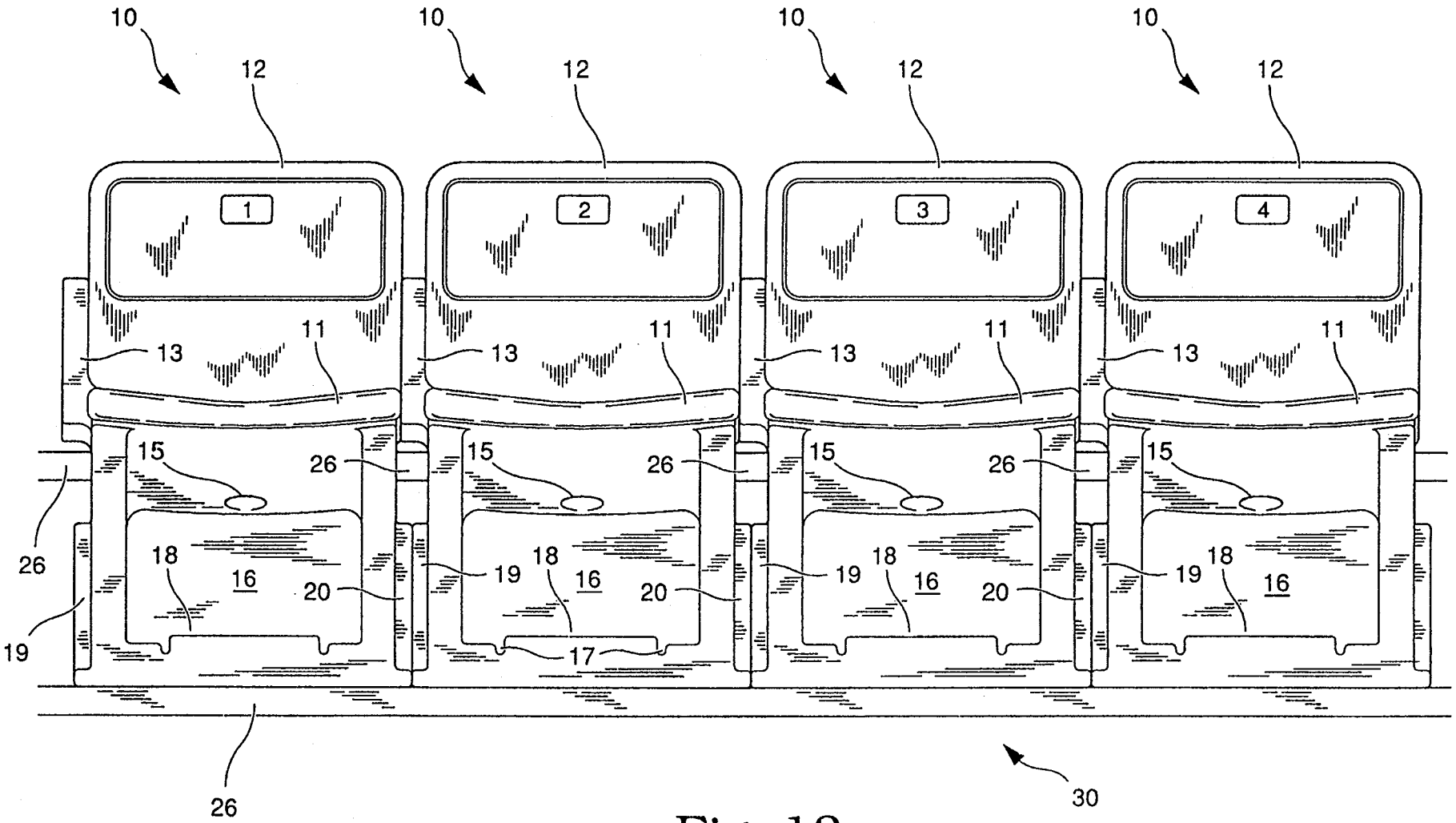
FIG. 13 is a fragmentary front elevation view showing a row of stadium chair modules of the type depicted in FIG. 1 in their installed configuration.
Figure 14:
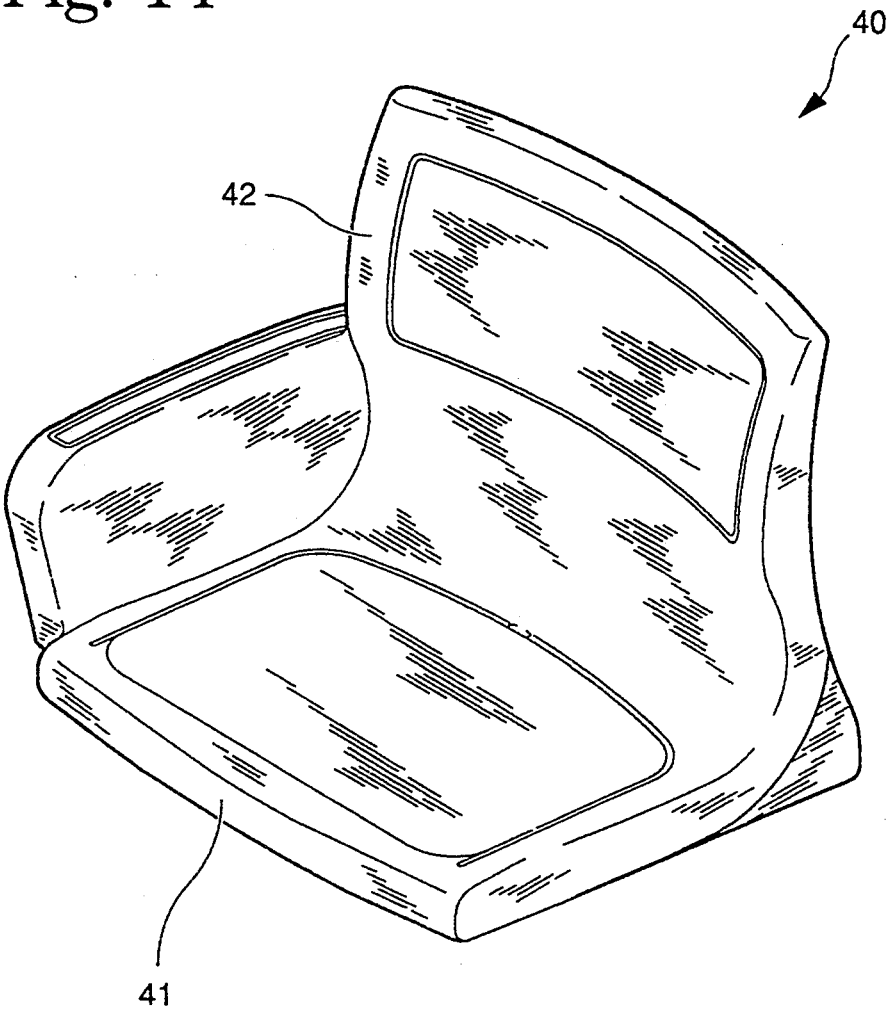
FIG. 14 is a perspective view of an alternative preferred embodiment of the stadium chair module of the present invention.
Figure 15:
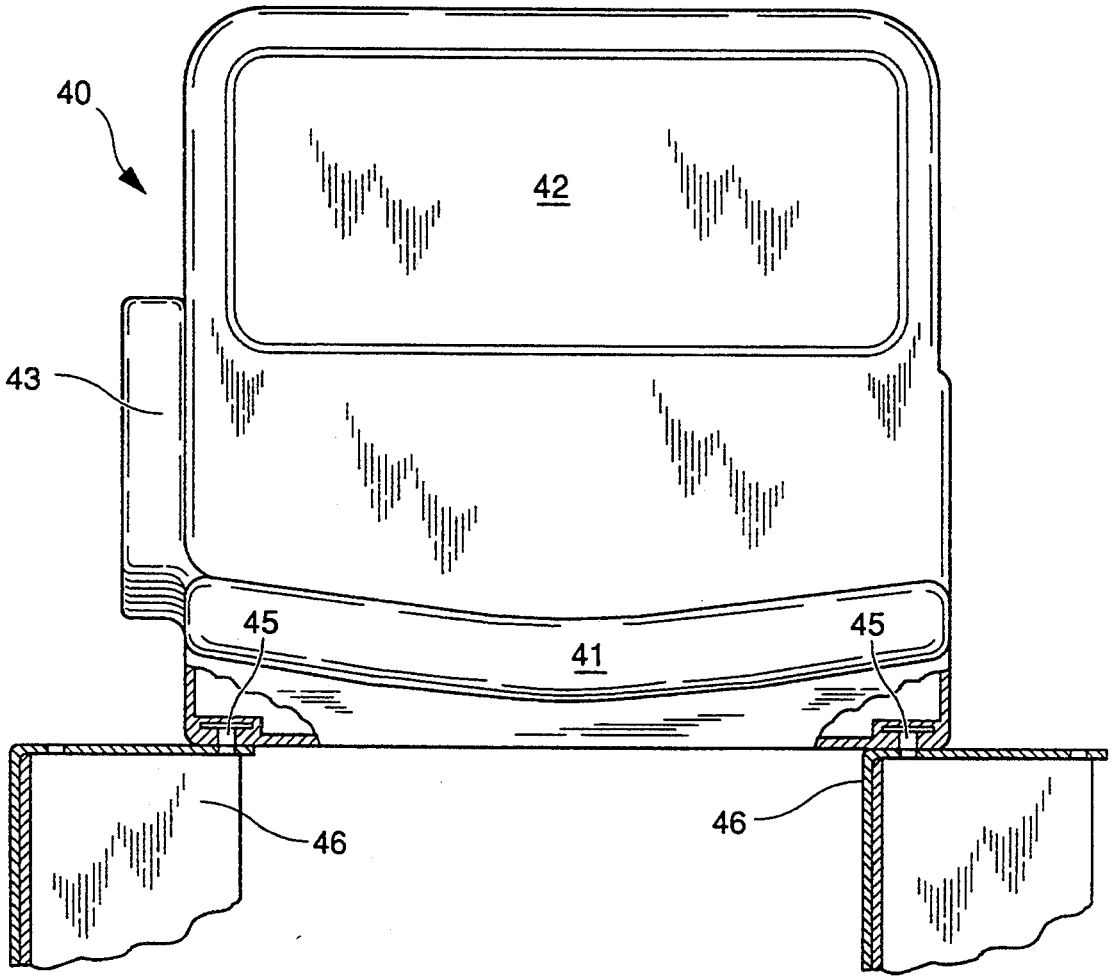
FIG. 15 is a front elevation view of the stadium chair module of FIG. 14 with a portion broken away to show the chair mounting .
Figure 16:
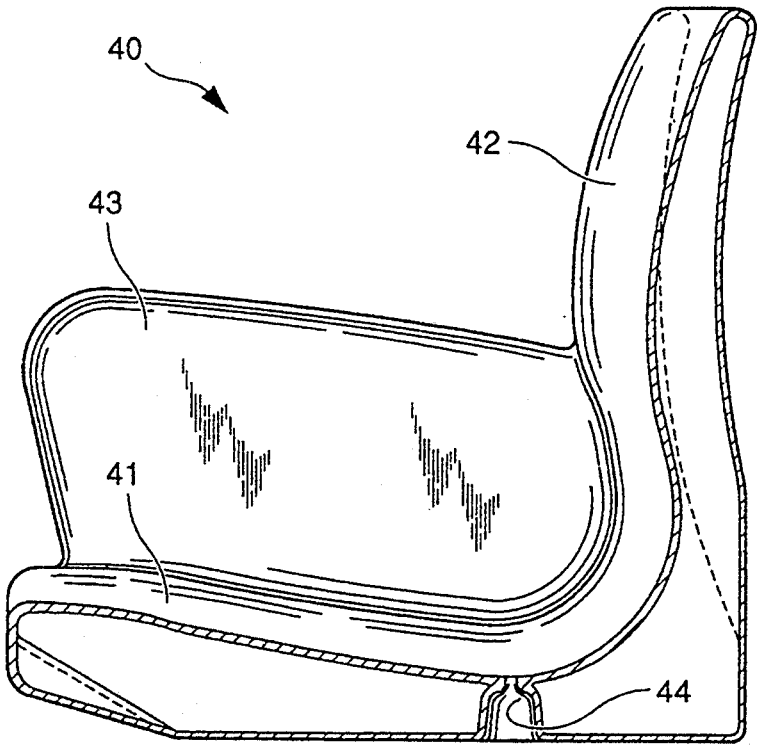
FIG. 16 is a section view taken along lines 16—16 in FIG. 15.
Figure 17:
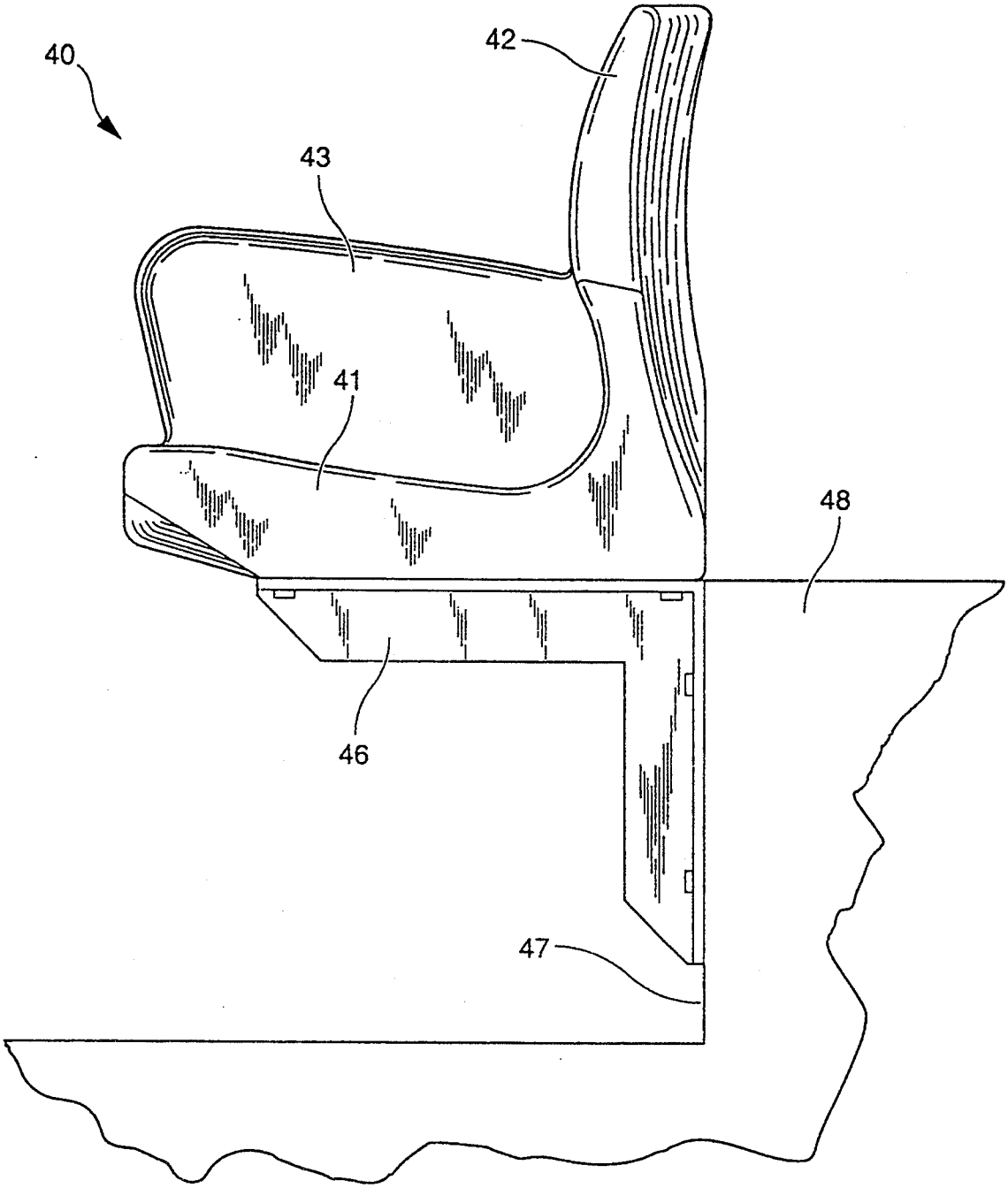
FIG. 17 is a right side elevation view of the stadium chair module of FIG. 14 shown in its installed position relative to a stadium seating understructure.

As seen in FIG. 13, chair modules 10 are installed side by side in abutting relation with the armrests 13 being shared between adjacent seats. The space between adjacent chairs is sealed by mating engagement of beads 21 and grooves 22 associated with channels 19 and 20, respectively. Thus, any water which falls or drains onto floorboards 26 will route to the space 37 between chair modules 10 where it will drain down along channels 19 and 20 to the next lower tier of the seating structure, and so on, until it reaches the bottom of the seating structure.

It may be appreciated that installation of the seating structure 30 is extremely simple, requiring only the securing of two fasteners for each chair module 10. In addition, the need for floorboards and riserboards extending in the space 50 beneath and behind the chair modules is eliminated, thus considerably reducing the cost to achieve a closed deck type seating structure.

FIGS. 14–18 depict an alternative preferred embodiment of the chair module of the present invention generally designated at 40. This embodiment is modified for installation in stadiums having conventional formed concrete tiered understructures. As with the previous embodiment, chair module 40 has a one piece molded plastic construction and integrally includes a seat portion 41, back portion 42, and armrest 43. A drain opening 44 located at a medial-aft position on the seat portion 41 and communicates any water collecting on the seat portion 41 to the underside thereof. The chair module 40 is rotationally molded to provide the hollow, double wall construction seen in FIG. 16.

In contrast to the previous preferred embodiment, chair module 40 does not have a depending seat support portion extending beneath seat portion 41. Rather, the underside of seat portion 41 is provided with a series of four UNC-type metal inserts 45 which are adapted to receive rivets or other suitable fasteners for mounting to a pair of L-brackets 46 in turn mounted to the riser surface 47 of a conventional concrete understructure 48. Inserts 45 are preformed and molded into position at the time chair module 40 is formed.

Figure 18:
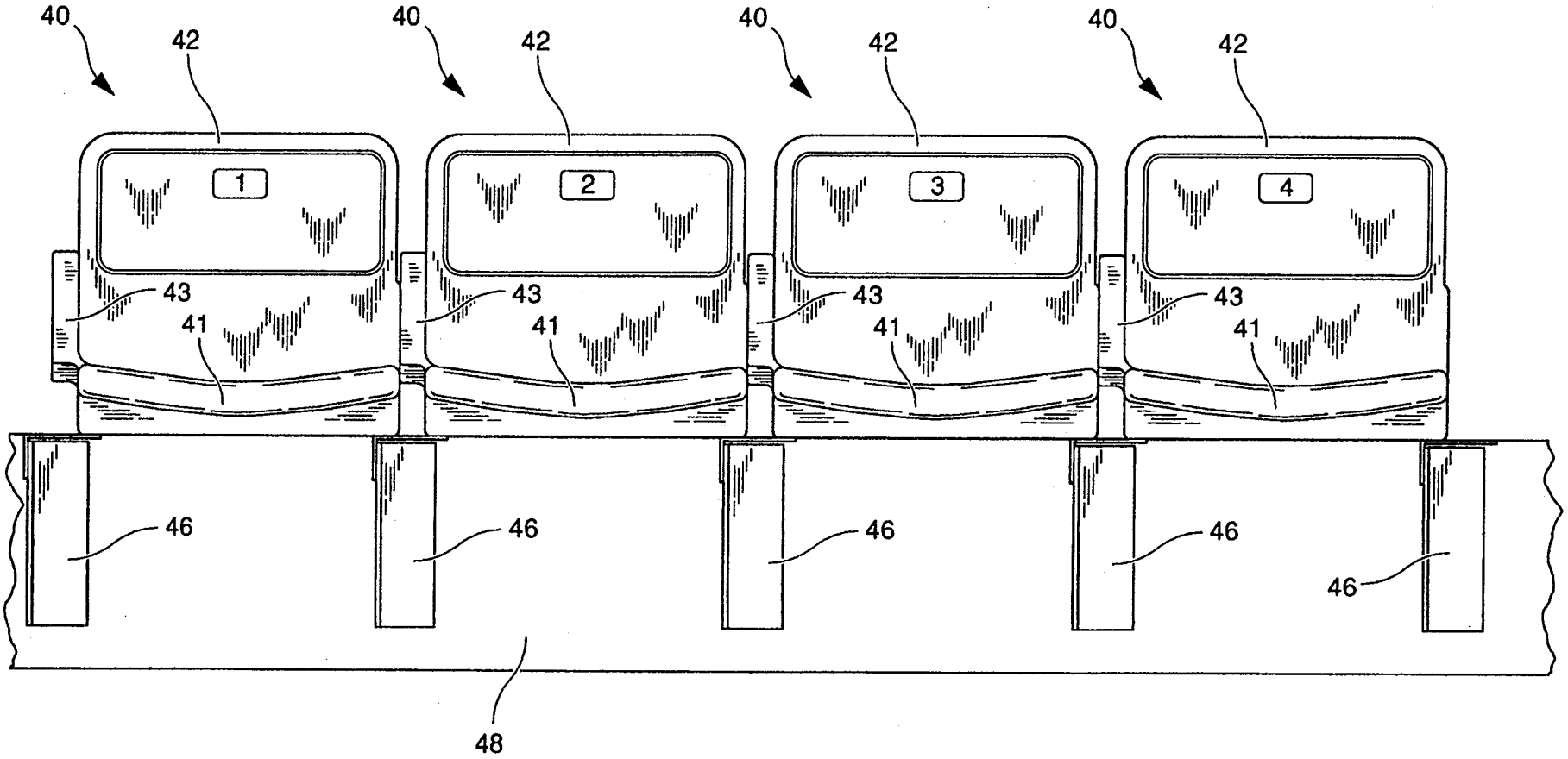
FIG. 18 is a fragmentary front elevation view showing a row of stadium chair modules of the type depicted in FIG. 14 in their installed configuration.

As in the previous embodiment the chair modules 40 are mounted in rows in an abutting relation as seen in FIG. 18 so as to provide shared armrests 43. However, since chair module 40 is intended for installation on conventional concrete type stadium understructure, there is no need to seal the space between adjacent chair modules to prevent water draining beneath the understructure, and therefore no watertight seal therebetween is provided.

It is anticipated that chair module 40 will find particular use in retrofitting applications in older stadiums having concrete understructures and bleacher-type seating.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A tiered stadium seating structure having a closed deck, comprising:

all understructure having a plurality of interconnected tiered risers and horizontally extending runners defining an open framework;

a plurality of floorboards supported upon and extending transversely across said horizontally extending runners, said floorboards only partially enclosing said open framework so as to define an unenclosed space between adjacent levels of said floorboards; and a plurality of identically formed chair modules, each said chair module having a one-piece molded plastic construction and integrally including a back, a seat rigidly connected to and formed with said back, an armrest, and a seat support extending downwardly from said seat, wherein each of said chair modules is mounted directly to adjacent ones of said floorboards extending forwardly of and behind said chair modules, said chair modules enclosing said unenclosed space between adjacent levels of said floorboards.

2. The seating structure of claim 1 wherein said chair modules further include a means for watertight sealing between adjacent ones of said plurality of chair modules in side by side relationship, and said chair modules further having shared armrests.

3. The seating structure of claim 2 wherein said sealing means includes a plurality of diagonally extending beads formed on one side of each said chair module and a corresponding plurality of diagonally extending grooves formed on an opposed side of each said chair module, said beads sized and arranged to be received in the grooves of an adjacent one of said chair modules.

4. The seating structure of claim 1 wherein said seat support includes a means for fastening said chair module to adjacent ones of said floorboards extending forwardly of and behind said chair module.

5. The seating structure of claim 1 wherein each of said chair modules further includes a storage compartment extending beneath said seat and having a forward facing access opening and enclosed side, rear, top and bottom walls.

6. The seating structure of claim 5 wherein said seat support defines at least one of said walls of said storage compartment.

7. The seating structure of claim 6 wherein said fastening means includes a plurality of preformed mounting holes in said storage compartment bottom wall.

8. The seating structure of claim 5 wherein said storage compartment bottom wall defines at least one drainage channel for draining water therefrom and said seat defines a drainage passageway communicating with said storage compartment.

9. The seating structure of claim 1 wherein adjacent ones of said chair modules define a downwardly inclined channel therebetween which communicates between adjacent rows of said chair modules and thereby facilitates drainage of water from said seating structure.

10. A tiered stadium seating structure, comprising:

a tiered understructure having a plurality of vertically extending riser and horizontally extending runner surfaces; and a modular seating system including a plurality of identically formed chair modules; wherein each said chair module is formed of a one-piece rotationally molded plastic material having a hollow, double-wall construction and integrally including a back portion, a seat portion rigidly connected to and formed with said back portion, an armrest, fasteners fastening said seat portion directly to said understructure of said tiered seating structure, and a plurality of diagonally extending beads formed on one side thereof and a corresponding plurality of diagonally extending grooves formed on an opposed side thereof, said beads sized and arranged to be matingly received in the grooves of an adjacent one of said chair modules, wherein said chair modules are mountable together in side-by-side relation in rows with adjacent ones of said chair modules having shared armrests.

11. The tiered stadium seating structure of claim 10 wherein each of said chair modules further includes a storage compartment extending beneath said seat and having a forward facing access opening and enclosed side, rear, top and bottom walls.

12. A tiered stadium seating structure, comprising:

a tiered understructure having a plurality of vertically extending riser and horizontally extending runner surfaces; and a modular seating system including a plurality of identically formed chair modules, wherein each said chair module is formed of a one-piece rotationally molded plastic material having a hollow, double-wall construction and integrally including a back portion, a seat portion rigidly connected to and formed with said back portion, an armrest, fasteners fastening said seat portion directly to said understructure of said tiered seating structure, and a storage compartment extending beneath said seat portion and having a forward facing access opening and enclosed side, rear, too and bottom walls, wherein said chair modules and mountable together in side-by-side relation in rows with adjacent ones of said chair modules having shared armrests.

* * * * *